US006431315B1

(12) United States Patent
Lewis

(10) Patent No.: US 6,431,315 B1
(45) Date of Patent: Aug. 13, 2002

(54) TREE STEP WITH STRAP ATTACHMENT

(75) Inventor: Kenneth D. Lewis, Wisconsin Rapids, WI (US)

(73) Assignee: K D L Outdoor Products, Inc., Wisconsin Rapids, WI (US)

( * ) Notice: Subject to any disclaimer, the term of this patent is extended or adjusted under 35 U.S.C. 154(b) by 0 days.

(21) Appl. No.: 09/694,240

(22) Filed: Oct. 23, 2000

(51) Int. Cl.[7] ..... E04G 3/00; A63B 27/00

(52) U.S. Cl. ..... 182/92; 182/136; 182/187

(58) Field of Search ..... 182/91, 187, 188, 182/135, 136; 248/216.1, 217.3, 219.03, 219.4, 238

(56) References Cited

U.S. PATENT DOCUMENTS

| | | | | | |
|---|---|---|---|---|---|
| 770,205 | A | | 9/1904 | Warren | |
| 852,623 | A | | 5/1907 | Roth | |
| 939,318 | A | | 11/1909 | Redman | |
| 1,152,211 | A | * | 8/1915 | Peirce, Jr. | 182/187 X |
| 1,409,800 | A | * | 3/1922 | Turner | 182/187 X |
| 2,168,111 | A | * | 8/1939 | Barnes | 182/187 |
| 3,746,294 | A | * | 7/1973 | Johnston | 248/219.4 |
| 4,000,788 | A | | 1/1977 | Burgess et al. | |
| 4,422,527 | A | | 12/1983 | Schultz et al. | |
| 4,427,092 | A | | 1/1984 | Tentler | |
| 4,582,168 | A | * | 4/1986 | Frey | 182/187 |
| 4,600,081 | A | * | 7/1986 | Wade | 182/187 |
| 4,601,364 | A | * | 7/1986 | York | 182/187 |
| 4,618,028 | A | | 10/1986 | Dale | |
| 4,620,610 | A | | 11/1986 | Southrad | |
| 4,674,597 | A | | 6/1987 | Humphrey | |
| 4,928,793 | A | * | 5/1990 | Westimayer et al. | 182/187 |
| 5,156,096 | A | * | 10/1992 | Lamprey | 182/187 X |
| 5,279,388 | A | * | 1/1994 | Laughlin et al. | 182/92 |
| 5,327,994 | A | | 7/1994 | Smith | |
| 5,427,201 | A | | 6/1995 | Hertel et al. | |
| 5,452,871 | A | * | 9/1995 | Sauber | 248/219.4 X |
| 5,732,793 | A | * | 3/1998 | Dech | 182/187 |
| 5,769,372 | A | | 6/1998 | Klosterman | |
| 5,810,113 | A | | 9/1998 | Jones | |
| 6,202,964 | B1 | * | 3/2001 | Thornhill | 248/219.4 |

OTHER PUBLICATIONS

Printout from http://www.ameristep.com/Steps1.htm dated Mar. 22, 2000, four pages.
Bowhunter Discount Warehouse, Inc.®, "America's Favorite Archery Supplier" pp. 164–165. No Date Available.
Cabela's Archery '99, pp. 74–76. No Month Available.

* cited by examiner

*Primary Examiner*—Daniel P. Stodola
*Assistant Examiner*—Hugh B. Thompson
(74) *Attorney, Agent, or Firm*—Lathrop & Clark LLP

(57) ABSTRACT

Two generally triangular segments of metal or plastic are rigidly or pivotably connected at an angle of about 45 degrees. A flexible strap extends through vertical slots formed in each segment. A strap connector, such as a double bar buckle, is positioned between the two segments. The strap extends through the first slot and around a portion of the strap connector, back out the first slot and around the joint between the segments and into the second slot. The strap passes from the second slot, around a portion of the strap connector, back out the second slot and then around the tree. The free ends of the strap are releasably connected. The edges of the segments may have upwardly angled teeth, such that when the tree step is secured against the tree by downward pressure, the upwardly angled teeth restrain the upward return of the tree step in response to the tension in the strap. Installed, strap tension restricts opening of the two segments, while the strap connector restricts collapse of the two segments. Alternatively, the tree step has a body with a sideward slot above a platform. A strap connector is positioned on the outwardly facing surface of the body. The strap extends through the strap connector and through the slot to securely position the climbing step. Three sided steps may have a strap which encircles a plate and extends through a slot.

17 Claims, 6 Drawing Sheets

TREE STEP WITH STRAP ATTACHMENT

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to climbing aids in general and to portable steps for removable attachment to tree trunks in particular.

For many types of game, an optimal hunting posture is a position elevated above the ground. Such a position may be obtained within a specially constructed hunting structure or blind which has an elevated platform and a secure ladder for ascent. However, these fabricated hunting blinds have the disadvantage that they are costly, time-consuming to erect, and strictly limited to one hunting location. Furthermore, erection of such structures on public lands can be problematic.

Hence, hunters will commonly climb trees to achieve a desired overhead position with respect to the targeted game. Occasionally, a tree will be provided with sturdy branches at optimal locations to permit the hunter to reach an elevated position. However, it is generally unlikely that a tree having branches at all the necessary locations will also be positioned within the forest at precisely the location the hunter wishes to employ. Furthermore, branches may be in various stages of decay not immediately apparent to the climber, making use of naturally occurring branches as climbing aids potentially hazardous.

Portable mechanical trees steps have been developed to assist the hunter in climbing any tree with a secure footing. One common tree step type has a block with a protruding screw which may be inserted into the tree and rotated to drive the screw into a secure attachment. Other trees steps require some type of drilling before attachment of the step. A drawback to this "wood screw" type attachment is that the living cambium of the tree is invariably pierced—with inherent biological damage to the tree. The cambium is the layer of tissue just beneath the bark. If the hunter is the owner of the affected tree such damage may be acceptable, as it is usually not fatal, although it may compromise the quality of the timber. However, much hunting activity is performed on public lands where environmental damage is undesirable, and, in many cases, unlawful.

An acceptable tree step must not harm the cambium of the tree, but at the same time must provide a secure support for the climber. In addition, installation and removal of a tree step should be straight forward, and easily done even in low light conditions which may be found in misty, early morning, or shaded conditions.

SUMMARY OF THE INVENTION

The tree step of this invention provides a secure and readily mounted step which is also lightweight and economically manufactured. The tree step in one embodiment has two generally triangular segments formed of metal or rugged plastic. The long sides of the triangular segments are connected at an angle of about 45 degrees. An upwardly extending slot is formed in each of the two triangular segments. A strap connector or bridge, such as a double bar buckle is positioned on the interior of the tree step between the two segments. A flexible strap extends through a first slot and around a portion of the strap connector, back out the first slot and around the joint between the triangular segments and into the second slot. The strap passes from the second slot, around a portion of the strap connector, back out the second slot and then around the tree. The free ends of the strap are releasably connected to one another by a buckle or a spring-buckle assembly. The edges of the segments which engage the tree are preferably provided with upwardly angled teeth, such that when the tree step is secured against the tree by downward pressure, the upwardly angled teeth restrain the upward return of the tree step in response to the tension in the strap. The joint between the two segments may be a hinge to allow the collapse of the tree step into a compact assembly. When installed, the tension in the strap restricts the opening of the two segments away from each other, and the strap connector between the two segments is larger than the slots, thereby restricting the collapse of the two segments toward each other. In an alternative embodiment, the tree step has a vertically extending body with a slot which extends from left to right through the body. A platform extends outwardly from the body for supporting a climber's foot, and a strap connector is positioned on the outwardly facing surface of the body. The strap extends through the two openings in the strap connector and through the slot in the body, to securely position the climbing step on the strap. Another embodiment has a three sided structure with a slot in a frontwardly facing plate through which the strap extends. In all embodiments, the tension of the strap secures the tree step at a desired location on the strap.

It is an object of the present invention to provide a tree step which attaches to the trunk of a tree without disturbing the cambium.

It is another object of the present invention to provide a tree step which is lightweight, yet durable and of adequate strength.

It is also an object of the present invention to provide a tree step which may be collapsed into a compact condition for transport.

It is a further object of the present invention to provide a tree step which is readily fixed in position on a supporting strap, yet easily repositioned when desired.

It is yet another object of the present invention to provide a tree step which remains in place when the load of the climber is relieved.

Further objects, features and advantages of the invention will be apparent from the following detailed description when taken in conjunction with the accompanying drawings.

DESCRIPTION OF THE PREFERRED EMBODIMENTS

Figure 1:
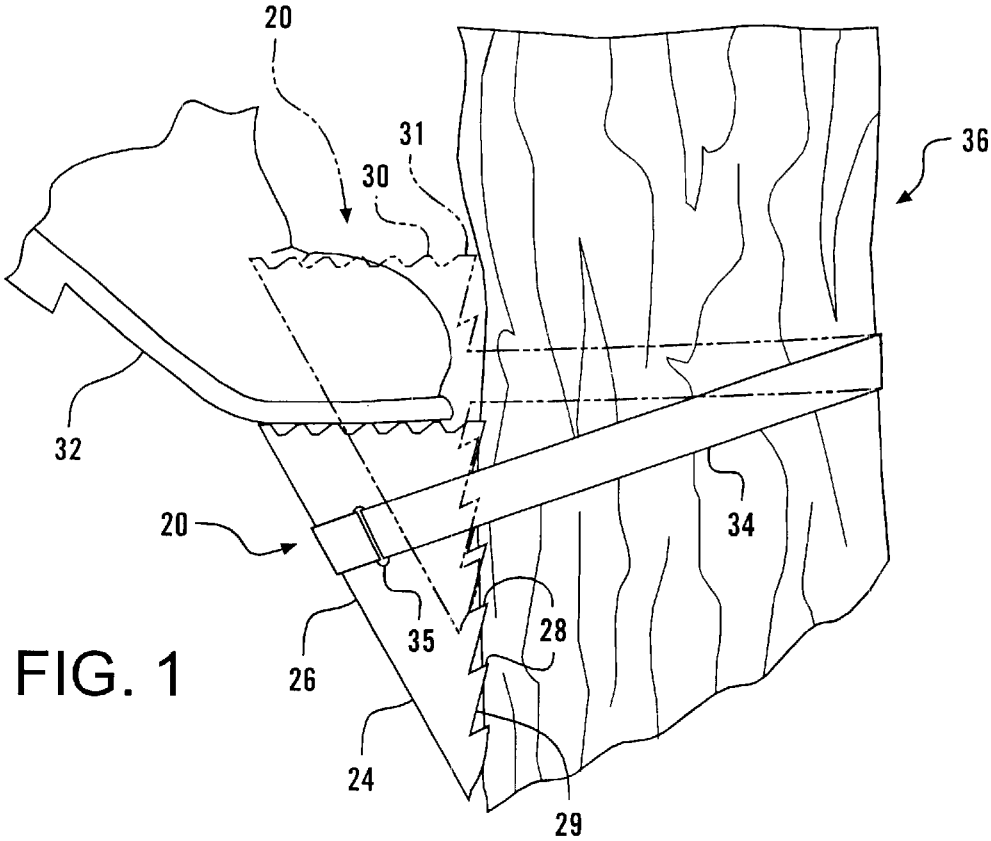
FIG. 1 is a side elevational view of a collapsible tree step of this invention.
Figure 2:
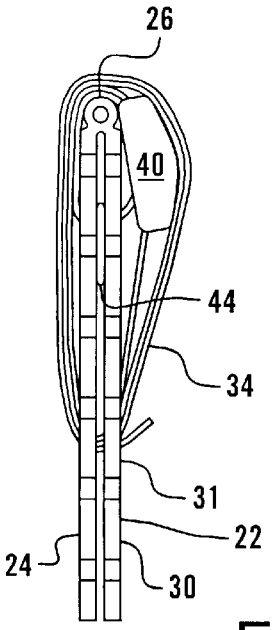
FIG. 2 is a top view of the collapsible tree step of FIG. 1.

Referring more particularly to FIGS. 1–10, wherein like numbers refer to similar parts, a tree step 20 is shown in FIGS. 1–2, 4, and 10. The tree step 20 may be fabricated in several segments permitting it to be stored and transported in a collapsed, reduced volume configuration, as shown in FIG. 2. The tree step 20 has a first generally triangular segment 22 which is pivotably connected to a second generally triangular segment 24 at a hinge 26 along a joint edge. Each triangular segment 22, 24 has a tree engaging edge 29 which faces away from the hinge 26 and which is provided with a plurality of upwardly angled teeth 28, as shown in FIG. 1. The segments may be formed of cold rolled steel, for example about ⅛ inch thick. Each biangular segment also has a plurality of upwardly extending protrusions 30 in a saw tooth pattern along an upper edge 31 which form a rough surface for engaging the foot 32 of a climber, typically wearing a boot. The upper edge 31 is approximately perpendicular to the tree engaging edge 29, so that the upper edge of he tree step, when installed on a tree, will extend generally parallel to the ground. The dimensions of the segments may be varied. The illustrated tree step 20, for example, has a tree engaging edge which is about 7 inches long, a hinge edge of about 7.5 inches, and an upper edge of about 3.25 inches.

Figure 3:
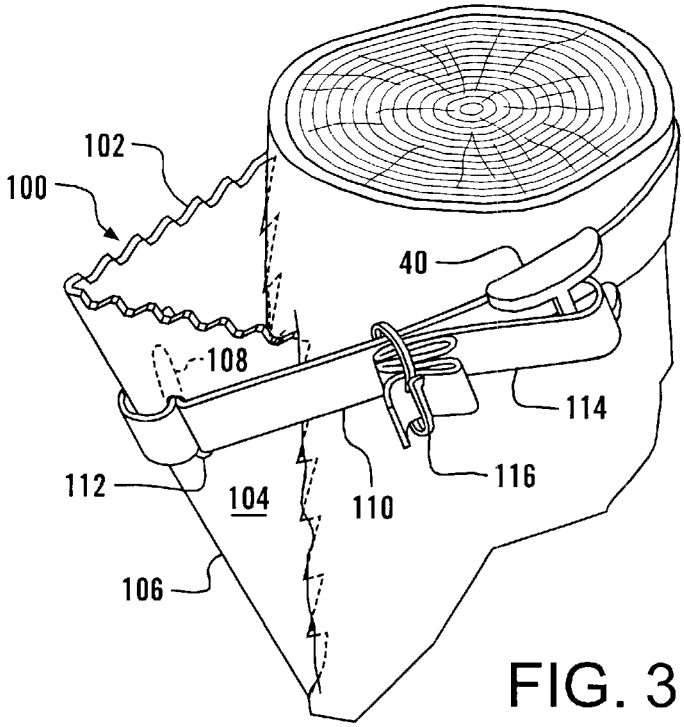
FIG. 3 is an isometric view of an alternative embodiment tree step of this invention which is not collapsible.

Each segment 22, 24 has a slot 33, 35 which extends parallel to the hinge 26. The slots are slightly larger than a flexible strap 34 which fixes the segments to a tree 36. The strap 34 may be approximately one to two inches wide, and is woven from natural or artificial fibers. The strap 34 has a first free end 38 to which a clip 40 is fastened, and a second free end 42 which is positionably and releasably received within the clip 40. The clip may be a buckle through which the strap is threaded as shown in FIGS. 2 and 3, or a spring loaded web strap buckle, as shown in the embodiment of FIG. 5.

Figure 4:
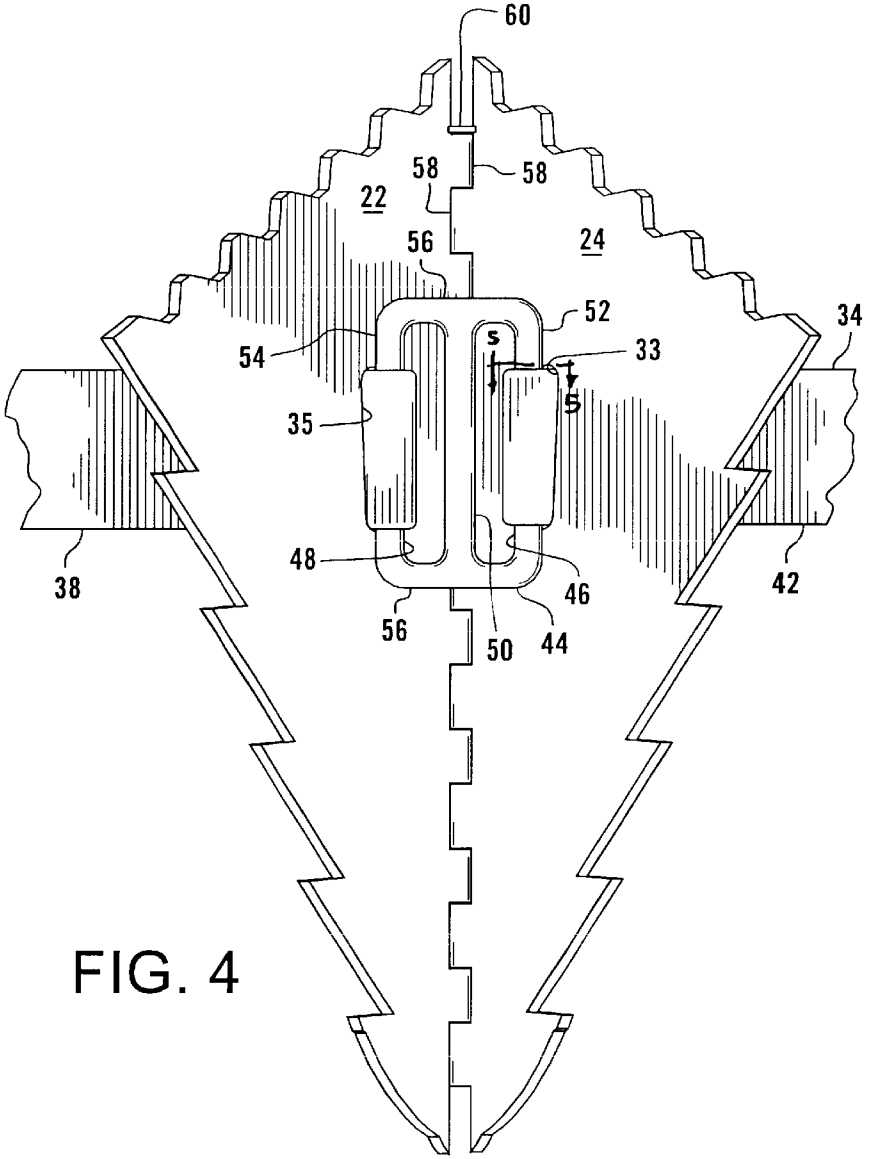
FIG. 4 is a rear elevational view of the tree step of FIG. 1, with the tree attachment strap partially broken away.

As shown in FIG. 4, a strap connector 44 is positioned between the first segment 22 and the second segment 24 at the level of the slots. The strap 34 is threaded through the connector 44 so as to fix the segments 22, 24 in position along the strap so long as tension is on the strap. The strap connector 44 has a first opening 46 separated from a second opening 48 by an inner bar 50. A first outer bar 52 extends on one side of the first opening 46, and a second outer bar 54 extends alongside the second opening 48. The inner bar 50, and the outer bars 52, 54 extend to parallel top and bottom bars 56. It should be noted that the inner bar 50, although stiffening the connector 44, may be omitted if the remaining members are sufficiently strong. The strap 34 extends from the tree and over the first segment 22 and in the first slot 33. The strap 34 passing through the first slot 33 extends across the first outer bar 52 on the side of the connector facing the tree. After crossing the first outer bar 52, the strap 34 extends through the first opening 46 and back out through the first slot 33. From the first slot 33, the strap 34 extends across the hinge 26 and into the second slot 35. From the second slot 35, the strap passes across the second outer bar 54 on the side facing away from the tree, and through the second opening 48 back across the second outer bar 54 and through the second slot 35 once again. From the second slot 35 the strap extends around the tree where the free ends of the strap are joined by the clip 40.

The strap connector 44 performs several functions in the tree step 20. First, the connector serves to securely position the triangular segments with respect to the strap 34, and thus serves to fix the tree step with respect to the tree. Second, by linking portions of the strap on the opposite segments, the strap connector forms a linked strap which extends through the segments and secures the strap to the segments, and restricts vertical displacement of the strap with respect to the segments. In addition, the strap connector 44 restricts the tipping or slipping of the belt with respect to the segments. Certain prior art devices have required rivets or other fasteners which pierce the strap in order to fix some element to the strap. The strap connector 44 avoids any piercing or puncturing of the strap, and thus avoids the inherent weakening of the strap. Furthermore, the strap connector 44 extends vertically a distance greater than the vertical height of the slots 33, 35, and serves as a structural member preventing the collapse of the two segments.

Figure 5:
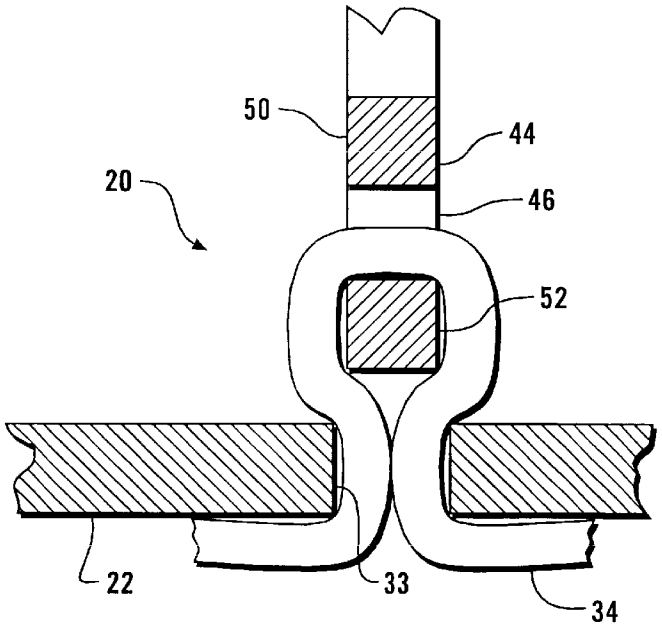
FIG. 5 is an enlarged fragmentary cross-sectional view of the tree step of FIG. 4 taken along section line 5—5.

Moreover, when tension is applied to the strap 34, as shown in FIG. 5, the strap connector 44 is pulled by the strap up against the slot 33 in the segment 22. However, the horizontal width of the slot 33 is only slightly larger than the combined width of the two thicknesses of strap which pass through the slot. The pulling force of the strap then causes the connector 44 to press against the strap thicknesses, urging them into the slot, but, because of the narrowness of the slot, the connector 44 compresses the strap as it passes through the slot 33 and secures the strap to the segment 22. The connector acts as a swedge, fixed to the rigid segment in such a way that the tree step 20 provides a very secure support to the climber.

As shown in FIG. 1, the tree step 20 is applied to a tree by looping the strap 34 around the trunk of the tree and securing the ends together at the clip 40. Typically the hand tightening of the strap in the clip is not sufficient to obtain a solid positioning of the tree step. However, by stepping forcefully on the upper edges of the triangular segments, the tree step moves from an initial position shown in phantom lines to a lowered, secured position, in which the strap 34 is stretched due to the wedge shape of the segments, and the increased length of the strap. The strap in this position is in tension and is exerting a force along the triangular segments which is directed back toward the tree. It is this force which would tend to collapse the triangular segments against one another which is resisted by the strap connector 44.

Figure 10:
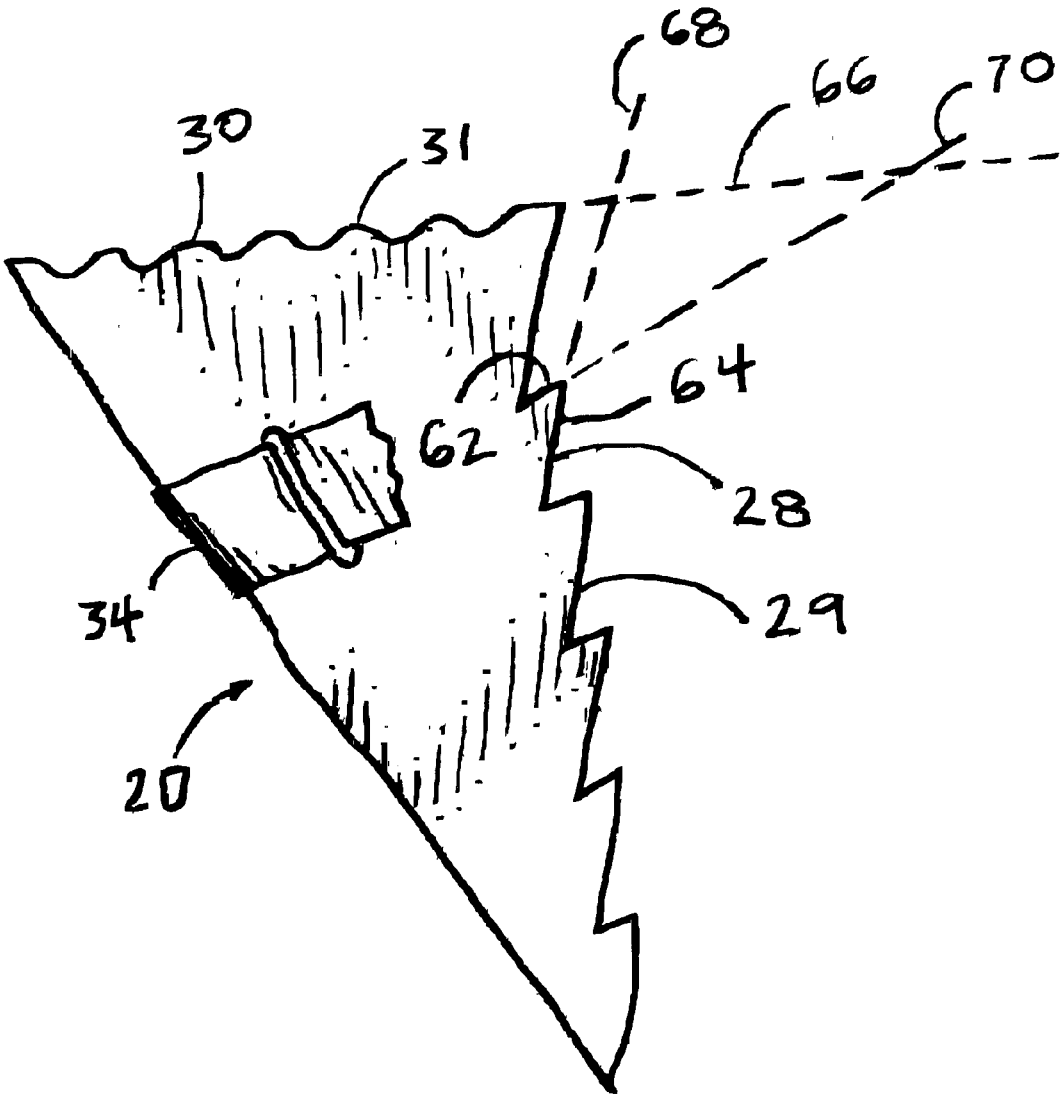
FIG. 10 is a fragmentary side elevational view of the tree step of FIG. 1.

Moreover, the upwardly inclined teeth 29 along the tree engaging edge of the triangular segments offer little resistance to downward displacement. The teeth do, however, offer significant resistance to the restoring force of The strap 34 which is urging the connected triangular segments upwardly. The teeth 28, which extend further from the hinge as they extend upwardly, contribute to the wedging of the segments of the tree step against the bark. As shown in FIG. 10, the first segment upper edge and the second segment upper edge 31 define an upper edge plane 66. Each tooth 28 along the tree engaging edge 29 has a top surface 62 and an outside surface 64 positioned below the top surface. The top surface 62 joins the outside surface 64 at the tip. The top surface 62 lies in a plane 70 which extends outwardly from the tree engaging edge 29 on which the tooth 28 is located to intersect the upper edge plane 66 The outside surface 64 of each tooth 28 lies in a plane 68 which intersects the upper edge plane 70. Moreover, the teeth 28 can hook the outside of the tree's mature bark, without damaging the cambium.

Thus, the teeth 28 help to retain the triangular segments in their lowered, secure, position—even when the climber has removed his foot from a particular tree step.

As shown in FIG. 2, the strap connector 44, although serving to keep the triangular segments spaced in the installed position at about 45 degrees, is readily collapsible once tension has been removed from the strap. Therefore, once the climber has descended below the level of a tree step, it may be released from its engagement with the tree by releasing the clip 40, and separating the two free ends of the strap from their connection to one another. Once released from the tree, the strap connector 44 may be folded toward the tree engaging edge of one segment, and the other segment may be folded to overlie the strap connector. Then, with the first segment, the strap connector, and the second segment approximately parallel to one another, the tree step is in a very compact configuration. The strap may be wrapped around the collapsed triangular segments. When in this collapsed configuration the tree step 20 is conveniently stored and transported.

As shown in FIG. 4, the pivotal connection between the first segment and the second segment may be defined by a series of inter-fitting hinge knuckles 58 through which a pin 60 is inserted. The pin may be retained within the knuckles by being epoxied in place at one end.

An alternative embodiment tree step 100 is shown in FIG. 3. The tree step 100 is similar to the tree step 20, except that it is not collapsible. A non-collapsible tree step may be desirable in that it may be less costly to manufacture. It has fewer parts, and if fabricated of metal, may be of narrower gauge, for example about 1/16 inch. The tree step 100 has a first triangular segment 102 connected to a second triangular segment 104 along a joint edge 106. Although there would be a tendency to hinge along the joint between the triangular segments 102, 104, the resistance of a strap connector 108 mounted between the two triangular segments provides significant stiffening to the structure, permitting, if desired, the use of lighter gauge metal or plastic for construction of the triangular segments with the associated reduction in cost and carrying weight. The strap 110 extends through upwardly extending slots 112 in the triangular segments and passes through the strap connector 108 as disclosed above with respect to the tree step 20. In both the tree step 20 and the tree step 100, the loose free end 114 is preferably restrained on the end of the strap to which the clip is fixed by two narrow strips of hook and loop fastener 116 which are releasably secured to one another to hold the loose free end 114 and prevent the loose free end from dangling and blowing in the wind which might cause an unnatural noise which would be disturbing to a hunter's prey.

Figure 6:
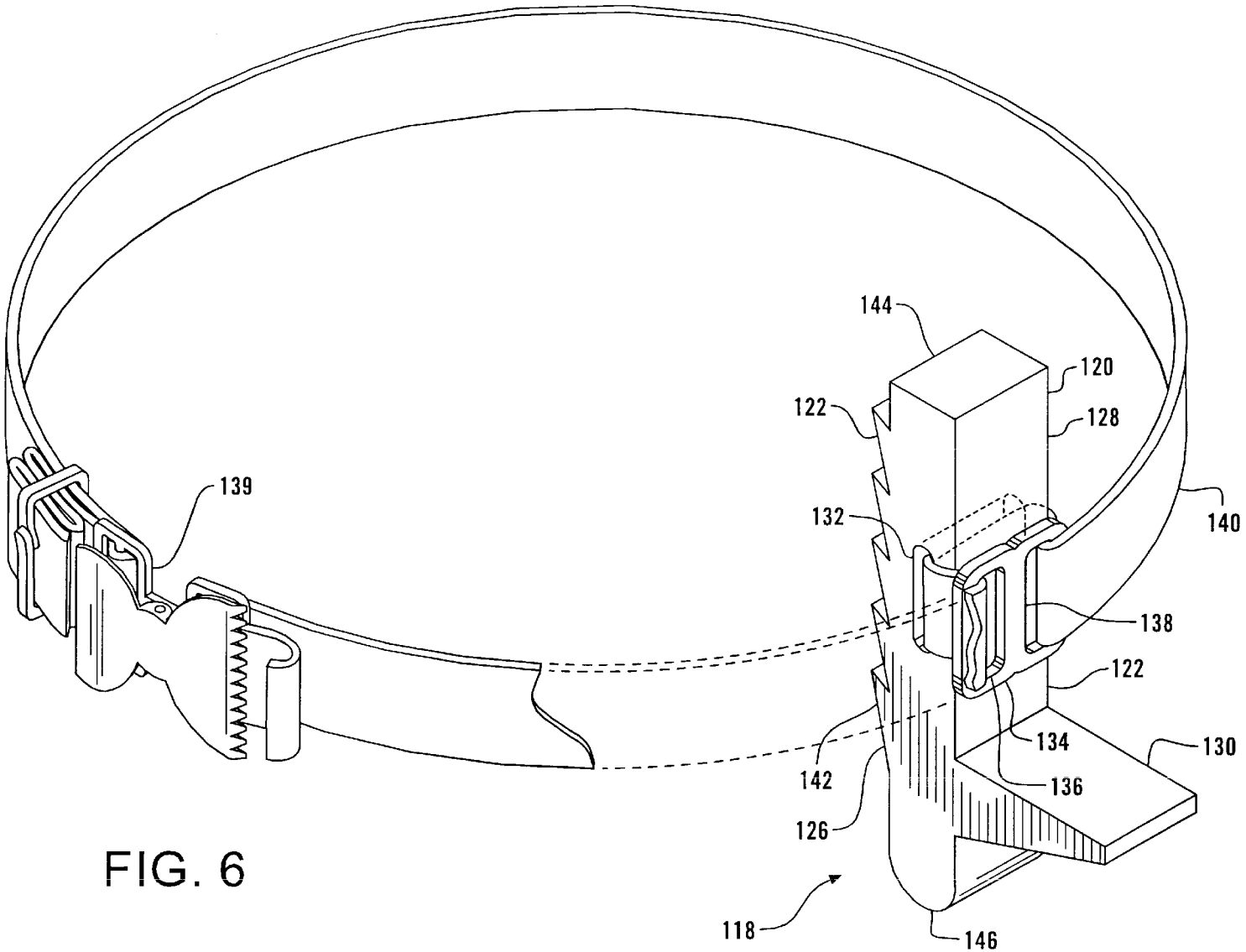
FIG. 6 is an isometric view of another alternative embodiment tree step of this invention.

Another alternative embodiment tree step 118 is shown in FIG. 6. The tree step 118 has a foot support which is similar to the one used in many conventional tree steps which have a simple molded, formed, wrought, or welded L-shaped member which connects to a tree trunk to form a step. However, many of these prior art tree steps employ a threaded screw end which unacceptably damages the tree cambium. The tree step 118 has an upwardly extending body member 120 having a tree engaging side 122 and an outwardly facing side 124. The outwardly facing side 124 is spaced from the tree engaging side 122 by a parallel left side 126 and a right side 128. A platform 130 projects outwardly from the outwardly facing side 124 of the body member 120. The platform 138 extends approximately perpendicularly to the body member 120 and provides a horizontal surface for receiving and supporting the foot of a climber. A slot 132 extends through the body member 120 from the left side 126 to the right side 128 and is sized to receive a woven strap there through. A strap connector 134, similar to the strap connectors disclosed above, is positioned approximately adjacent to the outwardly facing side 124 of the body member 120. The strap connector 134 has a first opening 136 and a second opening 138 spaced sidewardly from the first opening. It should be noted that a single opening in the strap connector will be sufficient, provided it is wide enough to accept at least two thicknesses of strap. A strap 140 extends into the strap connector first opening 136 and then into the body member slot 132 on the left side 126. The strap extends through the slot 132 through the body member to exit the slot on the right side 128, after which the strap extends through the second opening 138 of the strap connector and then back to encircle the tree and be connected to the other end of the strap. The strap first end is releasably connected at a spring loaded clip 139 to the strap second end for positionable attachment of the tree step to a tree.

The tree step 118 has a plurality of teeth 142 which protrude upwardly and rearwardly from the body member tree engaging side. Each tooth 142 is tapered as it extends upwardly and away from the body member, and has a lower surface which is inclined upwardly. The body member 120 has an upper edge 144 which terminates the tree step 118 at a point above the platform, and a lower edge 146 which terminates the tree step below the platform. The slot 132 is preferably approximately centered between the upper edge 144 and the lower edge 146. The strap, slot, and strap connector assembly serves to securely fasten the tree step 118 to the strap 140 when tension is applied to the strap, yet allows convenient repositioning of the step with respect to the strap when the strap is loose. It should be noted that many alternative platform and body member arrangements and connections may equally well be used with the tree step of this invention. For example, the platform may be hinged to the body member.

Figure 7:
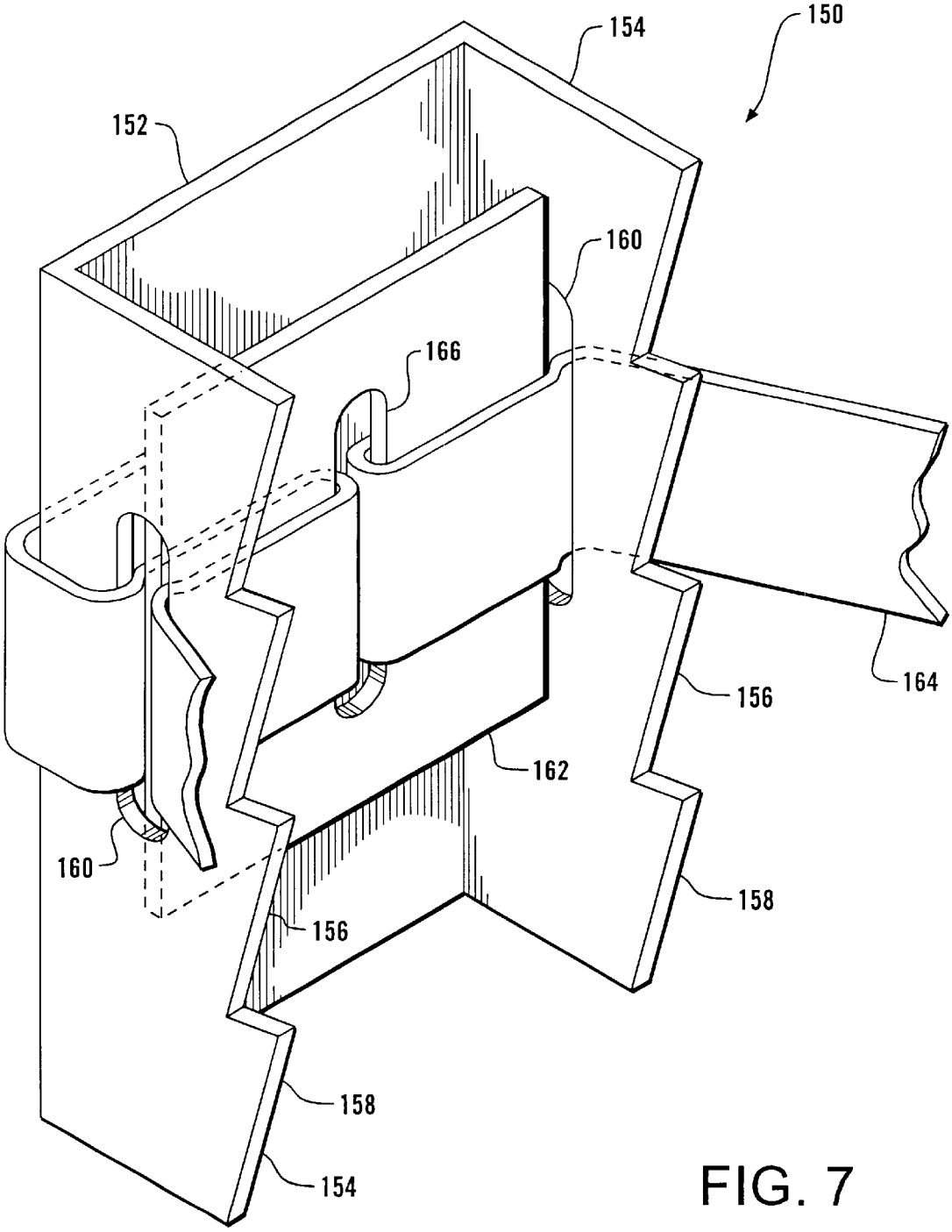
FIG. 7 is a rear isometric view of another alternative embodiment tree step of this invention having three perpendicular plates.
Figure 8:
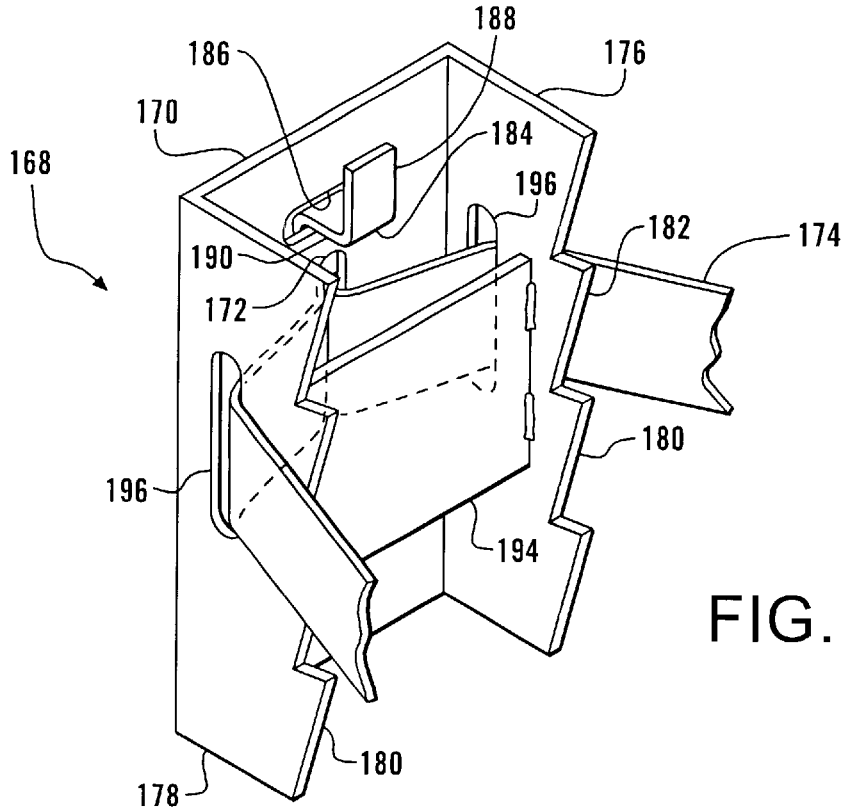
FIG. 8 is a rear isometric view of another alternative embodiment tree step of this invention having a welded brace and a pivotable release bar.
Figure 9:
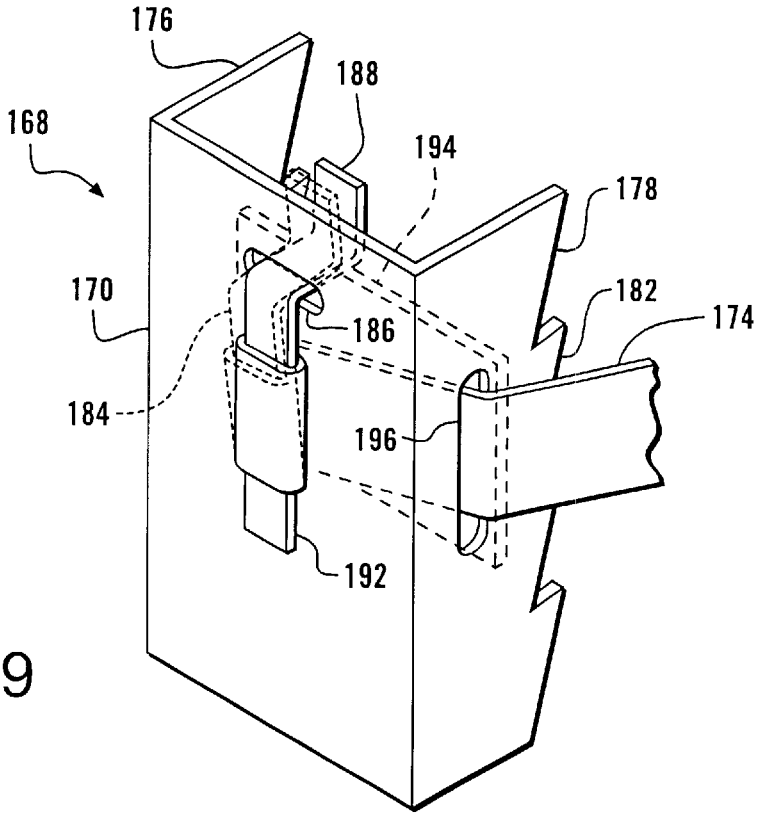
FIG. 9 is a front isometric view of the tree step of FIG. 8, with a belt adjustment position of the release bar shown in phantom view.

Alternative embodiment tree steps are shown in FIGS. 7–9, which have three perpendicular segments in a C-channel arrangement instead of the two segment V's discussed above. The tree step 150, shown in FIG. 7, has a rectangular front segment 152 and two rearwardly extending side segments 154. Each side segment 154 has a plurality of upwardly angled teeth 156 along the tree engaging edges 158 of the side segments. Each side segment 154 has a vertically extending slot 160. A slot plate 162 which is approximately as wide as the inside distance between the two side segments 154 is connected to the side segments by a strap 164. The strap 164 is wrapped around the tree and passes in through a slot in a first side segment 154, extends along the slot plate 162 and passes through a vertical slot 166 in the slot plate. The strap 164 then extends along the front surface of the slot plate 162 and back out the first side segment slot 160 and across the front segment 152. The strap 164 then turns the comer and extends rearwardly along the second side segment 154, into the second side segment slot 160, along the front surface of the slot plate 162, through the slot plate slot 166, along the rear surface of the slot plate, through the second side segment slot, and rearward to be connected to the other end of the strap by a connector, not shown. The tree step 150 may advantageously be used on a single strap with one or more additional similar tree steps. For example, three tree steps 150 may be mounted on a single strap 164 which is disposed to encircle a larger tree. In such an arrangement, a ratchet mechanism is preferably used to connect to the ends of the strap 164, such that tension may be applied to the strap in increments at a single location.

Another alternative embodiment tree step 168, shown in FIGS. 8 and 9, has a rectangular front segment 170 with a vertically extending front slot 172 which is approximately the width of two thicknesses of the strap 174. A first side segment 176 and a second side segment 178 extend rearwardly from the front segment 170 and terminate along tree engaging edges 180 with a plurality of upwardly angled teeth 182. A Z-shaped pivot member 184 extends through a horizontal slot 186 in the front segment 170 which is spaced above the front slot 172. The pivot member 184 has an upwardly extending grip 188 which extends to about the height of the upper perimeter of the tree step 168. A spacer segment 190 extends frontwardly from the grip 188 and joins a downwardly extending strip 192 which is longer than the width of the strap 174. To prevent the collapse of the two side segments 176, 178, a stiffening plate 194 is welded or otherwise affixed between the two side segments. Each side segment 176, 178 has a vertical slot 196 positioned between the stiffening plate 194 and the front segment 170.

The strap 174 encircles a tree and extends into the slot 196 on the first side segment 176. The strap extends from the slot 196 to the front slot 172 in the front segment 170, and then extends around the pivot member 184 strip 192 and back into the front slot 172. The strap then passes through the vertical slot 196 in the second side segment 178, and proceeds to be connected to another end of the strap with a fastener, not shown. When tension is applied to the strap 174, the pivot member 184 is pulled back against the front segment 170. However, because the pivot member 184 vertically extending strip 192 is wider than the front slot 172, the strip remains engaged frontwardly of the front segment. This engagement secures the front segment with respect to the strap 174, and prevents the tree step 168 from tipping or sliding with respect to the strap.

When it is desired to reposition the tree step 168 with respect to the strap 174, tension is released on the strap, and, as shown in FIG. 9, the grip 188 of the pivot member 184 is pushed frontwardly, away from the tree, to release the engagement of the strap around the vertically extending strip of the pivot member. Once slack has been introduced, it is possible to slide the tree step to another position on the strap 174. When the tree step 168 is in the desired position, tension can again be applied to the strap, and the tree step will once again be secured in place.

An advantage of the engagement structures between the straps and the tree steps of this invention over prior art steps in which a step is sewn directly to a strap, is that typically steps will be machine-sewn to a strap in such a fashion that some space must be left between a stiff member and the insertion position of the needle, with the necessity of some gap between the seam and the step structure. This gap allows for some looseness in the connection, perhaps a quarter inch or one half inch. This looseness gives an unpleasant sensation of insecurity to the climber as weight is applied. The steps of this invention avoid sewing, and rely on the releasable engagement between the stiff structure of the step and the strap, giving a more solid footing.

The tree steps of this invention may be formed of metal, plastic or other sufficiently rigid material.

It is understood that the invention is not limited to the particular construction and arrangement of parts herein illustrated and described, but embraces such modified forms thereof as come within the scope of the following claims.

I claim:

1. A tree step for attachment to a tree, the tree step comprising:

a first segment having an upper edge, and a tree engaging edge extending downwardly from the upper edge, and a joint edge extending downwardly from the upper edge;

a second segment having an upper edge, and a tree engaging edge extending downwardly from the upper edge, and a joint edge extending downwardly form the upper edge, wherein the first segment joint edge is connected to the second segment joint edge;

portions of the first segment defining an upwardly extending first slot positioned between the first segment joint edge and the first segment tree engaging edge;

portions of the second segment defining an upwardly extending second slot positioned between the second segment joint edge and the second segment tree engaging edge;

a strap connector positioned between the first segment and the second segment;

a strap extending through the first segment first slot and into the strap connector, and through the strap connector and out the first segment first slot, wherein the strap bas a first end which extends from the first slot, and a second end which extends from the second slot, the strap first end being releasibly connectable to the strap second end to positionably secure the tree strap to a tree, wherein the first segment joint edge is hinged to the second segment joint edge, and wherein the first segment is pivotable to overlie the second segment, with the strap connector flattened between the first segment and the second segment.

2. A tree step for attachment to a tree, the tree step comprising:

a first segment having an upper edge, and a tree engaging edge extending downwardly from the upper edge, and a joint edge extending downwardly from the upper edge;

a second segment having an upper edge, and a tree engaging edge extending downwardly from the upper edge, and a joint edge extending downwardly from the upper edge, wherein the first segment joint edge is connected to the second segment joint edge;

portions of the first segment defining an upwardly extending first slot positioned between the first segment joint edge and the first segment tree engaging edge;

portions of the second segment defining an upwardly extending second slot positioned between the second segment joint edge and the second segment tree engaging edge;

a strap connector positioned between the first segment and the second segment;

a strap extending through the first segment first slot and into the strap connector, and through the strap connector and out the first segment first slot, wherein the strap has a first end which extends from the first slot, and a second end which extends from the second slot the strap first ed being releasibly connectable to the strap second end to positionably secure the tree step to a tree, wherein the strap connector is positioned between the first segment and the second segment to prevent the collapse of the two segments towards one another when tension is applied to the strap.

3. The tree step of claim 2 wherein the upper edges of the first segment and the second segment each have a plurality of upwardly extending protrusions to form a gripping surfacing for engaging the boot of a climber.

4. The tree step of claim 2 wherein the tree engaging edge of the first segment and of the second segment has a plurality of teeth which extend away from the joint edge and which taper as they extend upwardly.

5. The tree step of claim 2 wherein the strap connector has a first opening defined between a first outer bar and an inner bar, and a second opening defined between the inner bar and a second outer bar, and wherein the strap extends through the first slot in the first segment, around the strap connector first outer bar and through the first opening and back out the first slot, and from the first slot across portions of the first segment and the second segment and into the second slot, through the slot into the connector segment second opening and then back out the second slot.

6. A collapsible tree step for attachment to a tree, the tree step comprising:

a first segment having an upper edge, and a tree engaging edge extending downwardly from the upper edge, and a joint edge extending downwardly from the upper edge;

a second segment having an upper edge, and a tree engaging edge extending downwardly from the upper edge, and a joint edge extending downwardly from the upper edge, wherein the first segment joint edge is pivotably connected to the second segment joint edge;

portions of the first segment defining an upwardly extending first slot positioned between the first segment joint edge and the second segment tree engaging edge;

portions of the second segment defining an upwardly extending second slot positioned between the second segment joint edge and the second segment tree engaging edge;

a strap connector positioned between the first segment and the second segment;

a strap extending through the first segment first slot and into the strap connector, and through the strap connector and out the second segment second slot, wherein the strap has a first end which extends from the first slot, and a second end which extends from the second slot, the strap first end being releasibly connectable to the strap second end to positionably secure the tree step to a tree, the collapsible tree step having a first, collapsed condition in which the first segment, the strap connector, and the second segment are approximately parallel to one another, and a second, expanded condition in which the strap connector is engaged between the first segment and the second segment.

7. The tree step of claim 6 wherein the upper edges of the first segment and the second segment each have a plurality of upwardly extending protrusions to form a gripping surfacing for engaging the foot of a climber.

8. The tree step of claim 6 wherein the tree engaging edges of the first segment and of the second segment each have a plurality of teeth which extend away from the joint edge and which taper as they extend upwardly.

9. The tree step of claim 6 wherein the strap connector has a first opening defined between a first outer bar and an inner bar, and a second opening defined between the inner bar and a second outer bar, and wherein the strap extends through the first slot in the first segment, around the strap connector first outer bar and through the first opening and back out the first slot, and from the first slot across portions of the first segment and the second segment and into the second slot, through the slot into the connector segment second opening and then back out the second slot.

10. The tree step of claim 6 wherein the first segment joint edge, the second segment joint edge, the first slot, and the second slot are approximately parallel to one another.

11. A tree step for attachment to a tree, the tree step comprising:

a first segment having an upper edge, and a tree engaging edge extending downwardly from the upper edge, and a joint edge extending downwardly from the upper edge;

a second segment having an upper edge, and a tree engaging edge extending downwardly from the upper edge, and a joint edge extending downwardly from the upper edge, wherein the first segment joint edge is connected to the second segment joint edge, the first segment upper edge and the second segment upper edge defining an upper edge plane;

a strap connected to the first segment and the second segment, and having two ends which extend rearwardly to encircle a tree and be connected together; and portions of the first segment tree engaging edge and the second segment tree engaging edge which define a plurality of upwardly sloped teeth, such that a tip of each tooth is spaced a greater distance from the joint edge than a base of said tooth, each tooth having a top surface and an outside surface positioned below the top surface, the top surface joining the outside surface at the tip, and wherein the top surface lies in a plane which extends outwardly from the tree engaging edge on which the tooth is located to intersect the upper edge plane, and wherein the outside surface of each tooth lies in a plane which intersects the upper edge plane, such that the upwardly sloped teeth are resistant to moving upwardly along a tree under the tension applied by the strap.

12. The tree step of claim 11 wherein the upper edges of the first segment and the second segment each have a plurality of upwardly extending protrusions to form a gripping surfacing for engaging the boot of a climber.

13. The tree step of claim 11 wherein the first segment has a first slot spaced from the joint edge, and the second segment has a second slot spaced from the joint edge, and wherein a strap connector is positioned between the first segment and the second segment, and the strap passes through the first slot and the second slot into engagement with the strap connector, and wherein the strap connector has a first opening defined between a first outer bar and an inner bar, and a second opening defined between the inner bar and a second outer bar, and wherein the strap extends through the first slot in the first segment, around the strap connector first outer bar and through the first opening and back out the first slot, and from the first slot across portions of the first segment and the second segment and into the second slot, through the slot into the connector segment second opening and then back out the second slot.

14. A tree step for attachment to a tree, the tree step comprising:

a first segment having an upper edge, and a tree engaging edge extending downwardly from the upper edge, and a joint edge extending downwardly from the upper edge;

a second segment having an upper edge, and a tree engaging edge extending downwardly from the upper edge, and a joint edge extending downwardly form the upper edge, wherein the first segment joint edge is connected to the second segment joint edge;

a strap connected to the first segment and the second segment, and having two ends which extend rearwardly to encircle a tree and be connected together; and portions of the first segment tree engaging edge and the second segment tree engaging edge which define a plurality of upwardly sloped teeth, such that a tip of each tooth is spaced a greater distance from the joint edge than a base of said tooth, such that the upwardly angled teeth are resistant to moving upwardly along a tree under the tension applied by the strap, wherein the first segment joint edge is hinged to the second segment joint edge, and wherein the first segment is pivotable to overlie the second segment, and whereon a strap connector is positioned between the first segment and the second segment, and the strap passes through slots In the first segment and the segment and into engagement with the strap connector.

15. A tree step and strap assembly comprising:

a strap having a first thickness, and extending in a loop to encircle a tree;

a tree step having at least a first upwardly extending segment and a second upwardly extending segment, each of the first segment and the second segment having upper portions which support a climber's foot; and portions of the first and second upwardly extending segments which define a plurality of upwardly extending slots, including a first vertical slot in the first segment, and a second slot in the second segment, through which the strap extends, wherein each of the first segment and the second segment has a tree engaging edge which is positioned rearwardly of the first slot and the second slot respectively, and wherein the strap extends through the first vertical slot, which is of a second thickness, then passes around an upright member of a third thickness, and returns through the first vertical slot, then extends into the second slot in the second segment, around another upright member, and back out the second slot, and wherein the first vertical slot second thickness is greater than twice the strap first thickness and less than the sum of twice the strap first thickness and the upright member third thickness, such that when tension is applied to the strap, the upright member is urged against the strap thickness as they pass through the vertical slot to fix the tree step in position on the strap.

16. The tree step and strap assembly of claim 15 wherein the tree step upwardly extending segments comprise a first side segment and a second side segment, and wherein a first vertical slot is formed in each of the first side segment and the second side segment.

17. A tree step and strap assembly comprising:

a strap having a first thickness, and extending in a loop to encircle a tree;

a tree step having upwardly extending segment& wherein at least two of said segments have upper portions which support a climber's foot; and portions of the upwardly extending segments defining a plurality of upwardly extending slots, including a first vertical slot, through which the strap extends, wherein the strap extends through the first vertical slot, which is of a second thickness, then passes around an upright member of a third thickness, and returns through the first vertical slot, and wherein the first vertical slot second thickness is greater than twice the strap first thickness and less than the sum of twice the strap first thickness and the upright member third thickness, such that when tension is applied to the strap, the upright member is urged against the strap thickness as they pass through the vertical slot to fix the tree step in position on the strap, wherein the tree step upwardly extending segments comprising a first side segment and a second side segment, and wherein a first vertical slot is formed in each of the first side segment and the second side segment, and wherein the first side segment is pivotably connected to the second side segment.

* * * * *